US007220027B2

(12) United States Patent
Rugee et al.

(10) Patent No.: US 7,220,027 B2
(45) Date of Patent: May 22, 2007

(54) MODULAR LIGHTING FIXTURES AND METHODS FOR FORMING LIGHTING FIXTURES

(75) Inventors: Todd B. Rugee, San Francisco, CA (US); John D. Stone, Palmer Lake, CO (US)

(73) Assignee: Boyd Lighting Fixture Company, San Francisco, CA (US)

( * ) Notice: Subject to any disclaimer, the term of this patent is extended or adjusted under 35 U.S.C. 154(b) by 232 days.

(21) Appl. No.: 10/998,461

(22) Filed: Nov. 29, 2004

(65) Prior Publication Data

US 2005/0083701 A1 Apr. 21, 2005

Related U.S. Application Data

(63) Continuation-in-part of application No. 10/346,234, filed on Jan. 17, 2003, now Pat. No. 6,863,423.

(51) Int. Cl.
*F21S 8/06* (2006.01)

(52) U.S. Cl. ..... 362/404; 362/250; 362/252; 362/382; 362/405; 362/406; 362/806; 248/302; 248/303; 248/304; 248/305; 248/309.1; 248/343

(58) Field of Classification Search ..... 362/404–406, 362/806, 382, 250, 252; 248/302–305, 309.1, 248/343, 340, 308; D26/80–84
See application file for complete search history.

(56) References Cited

U.S. PATENT DOCUMENTS 2,117,137 A 5/1938 Blatz ..... 59/78.1
2,753,445 A 7/1956 Thomas et al. ..... 240/78
3,943,353 A * 3/1976 Tada ..... 362/404
3,979,584 A * 9/1976 Fossati ..... 362/405
4,273,405 A 6/1981 Law ..... 339/94 R
4,634,307 A * 1/1987 Gnaedinger et al. ..... 403/194
4,676,573 A * 6/1987 Norman ..... 439/318
4,789,759 A 12/1988 Jones ..... 174/65
4,965,701 A * 10/1990 Voland ..... 362/565

(Continued)

OTHER PUBLICATIONS

Lighting Fixture, copy of photograph, displayed in Dallas Texas in 1960's.

(Continued)

*Primary Examiner*—Stephen F Husar
*Assistant Examiner*—Meghan K. Dunwiddie
(74) *Attorney, Agent, or Firm*—Heslin Rothenberg Farley & Mesiti P.C.

(57) ABSTRACT

A modular lighting fixture includes an elongated support and a plurality of objects such as crystals attachable to and suspendable from the support. A plurality of the modular lighting fixtures may be readily assembled and attached to or supported from a ceiling in various configurations such as being spaced-apart, in an elongated curtain, in a rectangle, and/or in a zigzag configuration. In one embodiment, the support includes an elongated upper member having a first width and a first length, an elongated lower member having a second width and a second length and being spaced-apart from the upper member, and wherein the first length equals the second length and the first width is greater than the second width. In another embodiment, an elongated modular lighting fixture includes a plurality of cable grips connected to the support for hanging the plurality of objects from the support.

67 Claims, 8 Drawing Sheets

U.S. PATENT DOCUMENTS

| | | | | | |
|---|---|---|---|---|---|
| 5,104,082 | A | * | 4/1992 | Bayer | 248/303 |
| 5,181,777 | A | * | 1/1993 | Segill et al. | 362/405 |
| 5,188,332 | A | * | 2/1993 | Callas | 248/544 |
| 5,241,460 | A | * | 8/1993 | Schonbek | 362/405 |
| 5,285,364 | A | * | 2/1994 | Bayer | 362/405 |
| 5,317,493 | A | | 5/1994 | Muller et al. | 362/407 |
| 5,339,618 | A | | 8/1994 | Sawyer | 59/93 |
| 5,567,046 | A | * | 10/1996 | Lucas | 362/405 |
| 5,773,758 | A | | 6/1998 | Coutureau et al. | 174/65 R |
| 6,126,305 | A | | 10/2000 | Swarovski | 362/565 |
| 6,155,526 | A | * | 12/2000 | Brown | 248/303 |
| 6,317,632 | B1 | * | 11/2001 | Krig et al. | 607/14 |
| 6,474,841 | B1 | * | 11/2002 | Rahman | 362/252 |
| 6,517,223 | B2 | * | 2/2003 | Hsu | 362/405 |
| 6,565,240 | B1 | * | 5/2003 | Wu | 362/405 |
| 6,761,342 | B1 | * | 7/2004 | Giefer et al. | 248/343 |
| 2005/0099811 | A1 | * | 5/2005 | Cheng | 362/252 |

OTHER PUBLICATIONS

Rugee, pending U.S. Appl. No. 29/174,442, filed Jan. 17, 2003, entitled "Lighting Fixture".

Rugee, pending U.S. Appl. No. 29/174,445, filed Jan. 17, 2003, entitled "Lighting Fixture".

Rugee, pending U.S. Appl. No. 29/174,441, filed Jan. 17, 2003, entitled "Lighting Fixture".

Rugee, pending U.S. Appl. No. 29/174,446, filed Jan. 17, 2003, entitled "Lighting Fixture".

John Sweet Sr., Untitled light fixture, displayed at the Dallas Fairmont Hotel in the Pyramid Room, about 1964.

GripLock Gliders available from Griplock Systems of Carpinteria, California, http://www.griplocksystems.com, 3 pages.

Stone, et al., "Lighting Fixtures Having Releasably Attachable Objects and Methods For Trimming Lighting Fixtures," pending U.S. Appl. No. 10/346,234, filed Jan. 17, 2003.

* cited by examiner

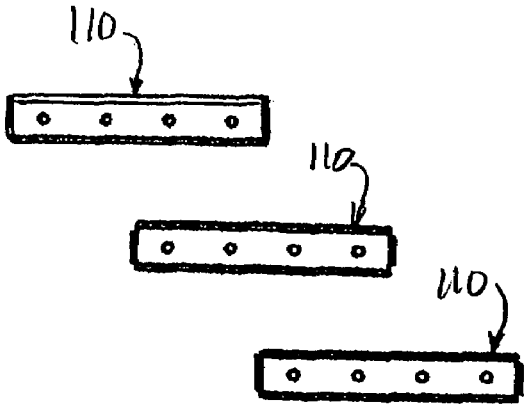
FIG. 4
FIG. 5
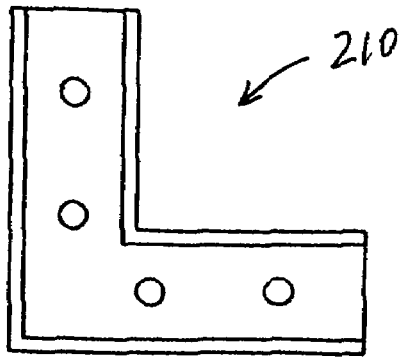
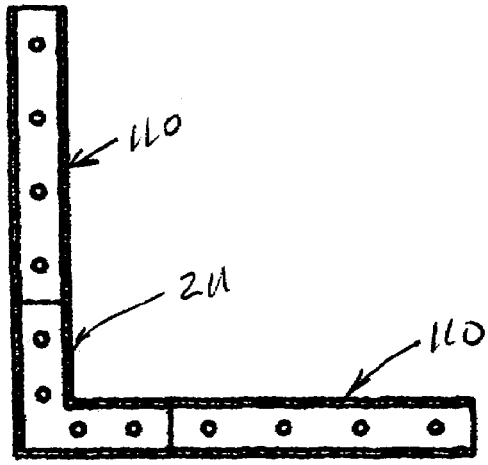
FIG. 6

MODULAR LIGHTING FIXTURES AND METHODS FOR FORMING LIGHTING FIXTURES

RELATED APPLICATION

This application is a continuation-in-part of U.S. patent application Ser. No. 10/346,234 filed Jan. 17, 2003, entitled "Lighting Fixtures Having Releasably Attachable Objects And Methods For Trimming Lighting Fixtures," now U.S. Pat. No. 6,863,423, the entire subject matter of which is incorporated herein by reference.

FIELD OF THE INVENTION

This invention relates generally to lighting fixtures, and more particularly, to modular lighting fixtures and methods for forming lighting fixtures.

BACKGROUND OF THE INVENTION

Lighting fixtures such as chandeliers typically include a central member with or without outwardly-extending arms that support crystal ornaments. Each crystal ornament is typically separately attached to an arm with a wire. For example, a crystal ornament is typically attached to a wire and an upper end of the wire is wrapped or hooked onto the central member or one of the arms. Conventional chandeliers are stand-alone units that are attached or supported from a ceiling.

There is a need for further lighting fixtures, and in particular, modular lighting fixtures and methods for forming lighting fixtures.

SUMMARY OF THE INVENTION

The present invention provides in a first aspect, a modular lighting fixture which includes an elongated upper member having a first width and a first length, an elongated lower member having a second width and a second length and being spaced-apart from the upper member, a plurality of objects attachable to and suspendable from the lower member, and wherein the first length equals the second length and the first width is greater than the second width.

The present invention provides in a second aspect, a modular lighting fixture having an elongated support, a plurality of objects, and a plurality of cable grips connected to the support for hanging the plurality of objects from the support.

The present invention provides in a third aspect, a modular lighting fixture which includes an elongated upper member, an elongated lower member having a plurality of spaced-apart openings for light bulbs and spaced-apart from the upper member, a sidewall disposed between the upper member and the lower member, a plurality of objects attachable to and suspendable from the lower member, and a plurality of cable grips connected to the lower member for hanging the plurality of objects from the lower member. The upper member has a first width and a first length, the lower member has a second width and a second length, and the first length equals the second length and the first width is greater than the second width. The plurality of objects includes a plurality of vertically suspended round-shaped crystal ornaments of varying lengths and comprising a plurality of spaced-apart large round-shaped crystals with a plurality of small round-shaped crystals spaced-apart therebetween.

The present invention also provides in other aspects, lighting fixtures incorporating the above-described modular lighting fixtures, and in still other aspects, methods for forming lighting fixtures incorporating the above-described modular lighting fixtures.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

FIG. 4 is a bottom view of a plurality of modular lighting fixtures (without the suspended objects) assembled in a spaced-apart and staggered configuration in accordance with he present invention;

FIG. 5 is a bottom view of an L-shaped modular lighting fixture (without the suspended objects) in accordance with the present invention;

FIG. 6 is a bottom view of an L-shaped lighting fixture (without the suspended objects) assembled from a plurality of modular lighting fixtures in accordance with the present invention;

DETAILED DESCRIPTION OF THE INVENTION

Figure 1:
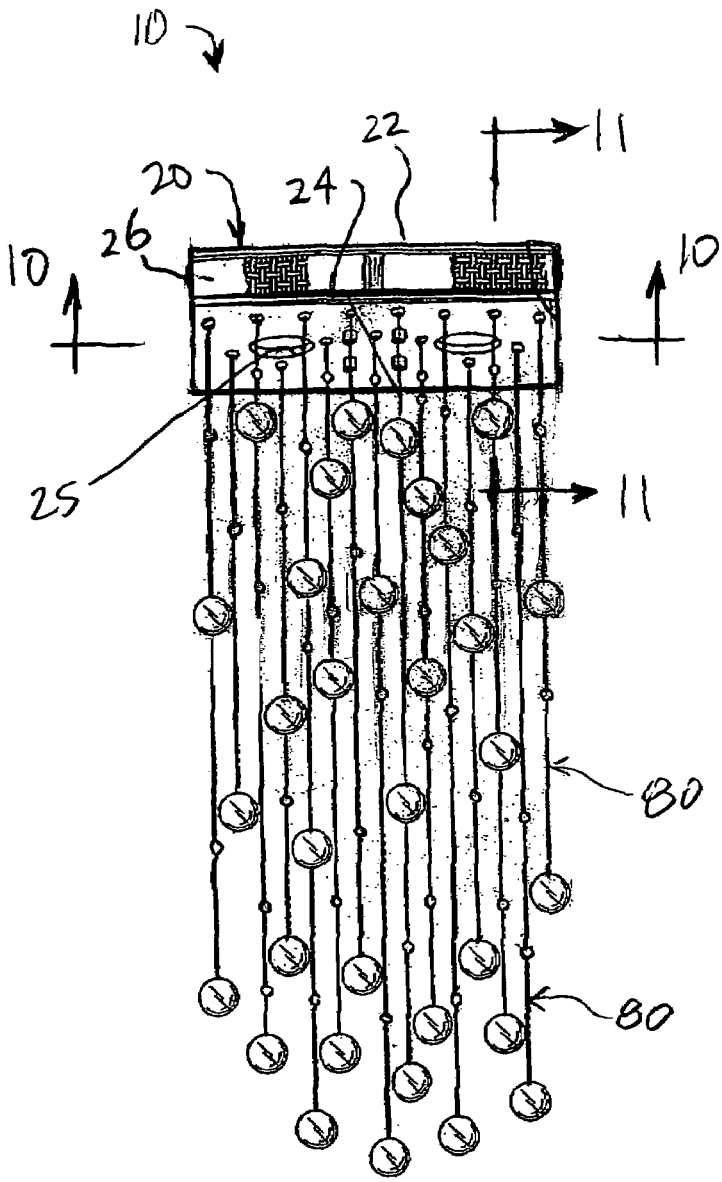
FIG. 1 is a perspective view of a modular lighting fixture (only a portion of the suspended objects being shown) in accordance with the present invention.
Figure 2:
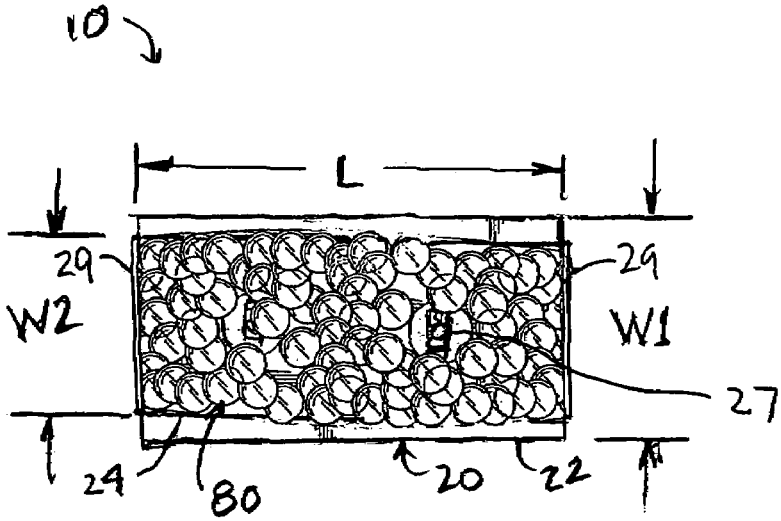
FIG. 2 is a bottom view of the modular lighting fixture of FIG. 1.

FIGS. 1 and 2 illustrate an elongated modular lighting fixture 10 in accordance with the present invention. Illustrated modular lighting fixture 10 includes a frame or support 20 and a plurality of objects 80 such as crystals (only some of which are shown in FIG. 1) attachable and suspendable from the support.

Figure 3:
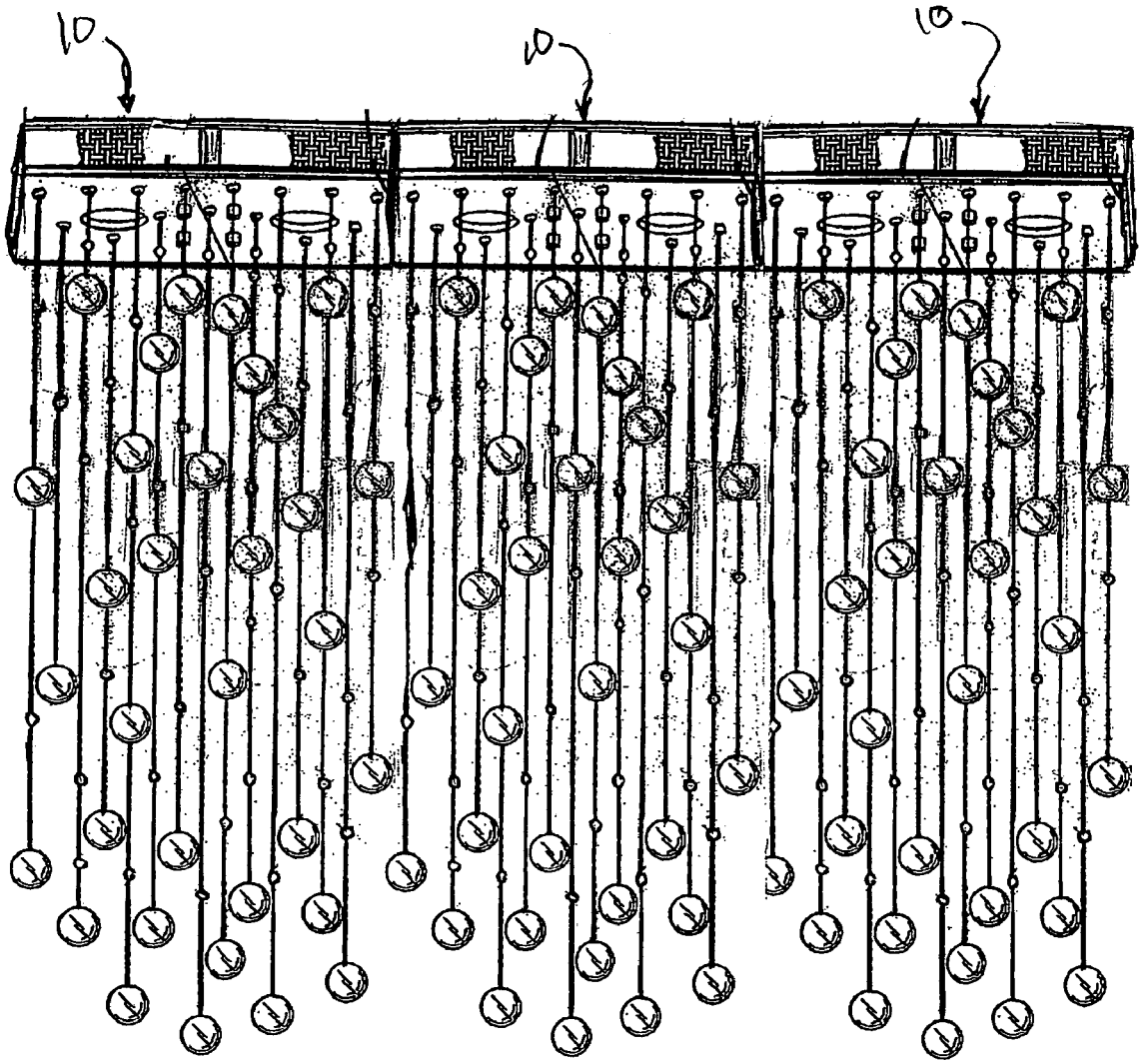
FIG. 3 is a perspective view of a plurality of modular lighting fixtures of FIG. 1 forming an elongated curtain.

As will become apparent from the description below, a plurality of the modular lighting fixtures of the present invention may be readily assembled into various configurations. For example, a plurality of elongated modular lighting fixtures 10 may be attached to a ceiling to form a curtain as shown in FIG. 3. In another example, a plurality of modular lighting fixtures 10 (shown without crystals) may be spaced-apart and staggered from one another as illustrated in FIG. 4.

Figure 7:
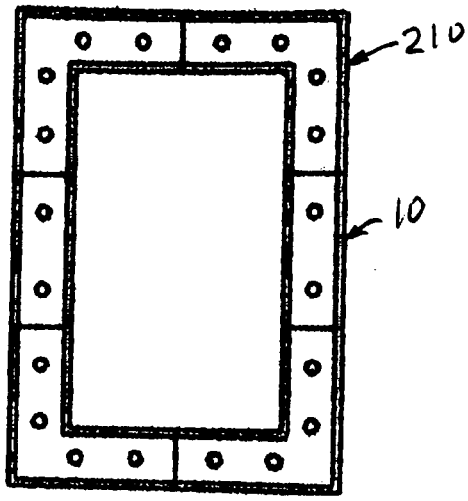
FIG. 7 is a bottom view a rectangular-shaped lighting fixture (without the suspended objects) assembled from a plurality of modular lighting fixtures in accordance with the present invention.
Figure 8:
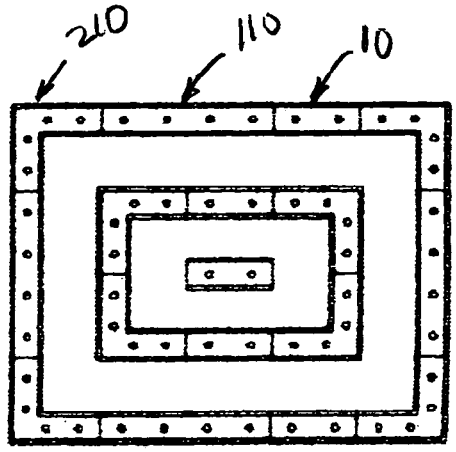
FIG. 8 is a bottom view a plurality of rectangular-shaped lighting fixtures (without the suspended objects) assembled from a plurality of modular lighting fixtures in accordance with the present invention.
Figure 9:
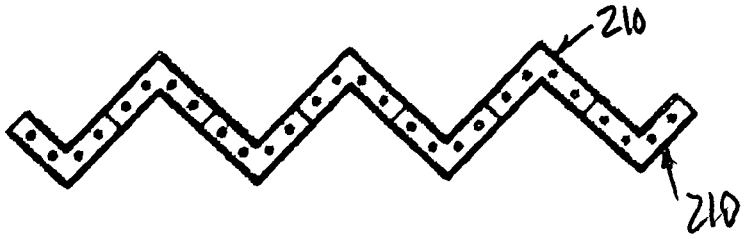
FIG. 9 is a bottom view a zigzag-shaped lighting fixture (without the suspended objects) assembled from a plurality of modular lighting fixtures in accordance with the present invention.

FIG. 5 illustrates an alternative embodiment of an elongated modular lighting fixture 210 (shown without crystals) having a L-shaped configuration in accordance with the present invention. The L-shaped elongated modular lighting fixture 210 and/or elongated modular lighting fixtures 10 and/or 110 may be assembled to form lighting fixtures in the form of an L-shaped curtain as shown in FIG. 6, a rectangular-shaped lighting fixture as shown in FIG. 7, a plurality of rectangular-shaped lighting fixtures as shown in FIG. 8, and a zigzag-shaped lighting fixture as shown in FIG. 9.

From the present discussion, it will be appreciated by those skilled in the art that other configuration for assembling the modular lighting fixtures of the present invention may be employed as well. In addition to the ability to form different configurations, the suspended objects may have different lengths to provide different vertical configurations. For example, with reference to FIG. 8, the outer rectangular-shaped lighting fixture may have relatively short strands of suspendable objects, the center rectangular-shaped lighting fixture have relatively longer strains of suspendable objects, and the outer rectangular-shaped lighting fixture may have still longer strains of suspendable objects.

With reference again to FIGS. 1 and 2, elongated modular lighting fixture 10 includes support 20, which in this example, may be rectangular in shape and formed from an upper member 22 such as a horizontal planar member, a spaced-apart lower member 24 such as a horizontal planar member, and a sidewall 26 disposed between the upper member and the lower member.

The upper member may be suitably attached directly to a ceiling or suspended from a ceiling. Lower member 24 may include a plurality of openings 25 therein. Inside support 20 may be suitable light bulb receptacles 27 (FIGS. 2 and 10) for receiving and supporting a light bulb such as a halogen light bulb in each of the plurality of openings for projecting light between the objects. Various floodlights and spotlights may be received in the receptacles. The modular lighting fixtures may use one or more light bulbs.

As shown in FIG. 2, upper member 22 has a first width W1. Lower member 24, which is spaced-apart from upper member 22, has a second width W2. Each of the members has the same length so that a plurality of modular lighting fixtures may be abutted against each other. The first width is greater than the second width. The modular lighting fixture may be about 1 foot to about 2 feet long and have a width of about 6 inches.

End caps 29 are suitably attachable at the ends of support 20. When a plurality of modular lighting fixtures is assembled and abutted together such as shown in FIGS. 3, 6, and 9, a pair end caps may be attached to the outermost ends of the assembled lighting fixture.

Figure 10:
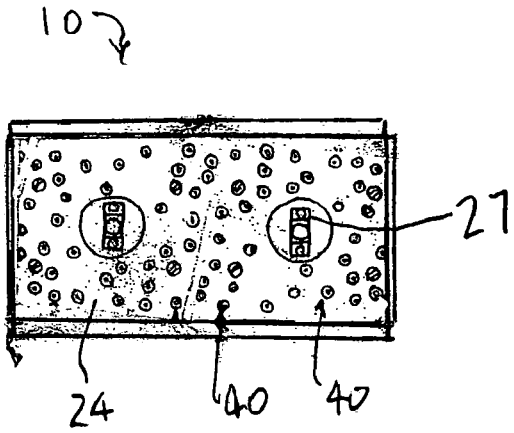
FIG. 10 is a bottom view of the lighting fixture taken along line 10-10 in FIG. 1 illustrating the support and the plurality of quick-disconnect connectors.

As shown in FIG. 10, the plurality of quick-disconnect connectors 40 may be attached to lower member 24 in a suitable pattern for supporting the hanging or suspended objects. From the present description, it will by appreciated by those skilled in the art that the modular lighting fixture of the present invention may include other types of connectors for attaching the hanging or suspended objects from the support. For example, hooks, fasteners, clasps, clip, or other suitable connectors may be employed for releasably and/or fixedly attaching the hanging or suspended objects from the support.

Figure 11:
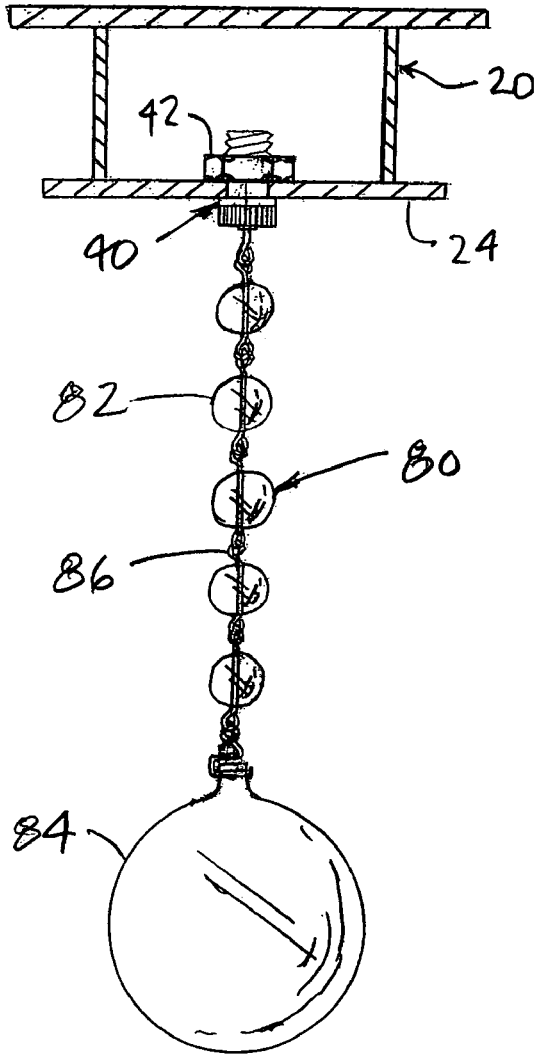
FIG. 11 is an enlarged, elevational view, in part cross-section, taken along line 11-11 in FIG. 1 illustrating a portion of the support, one of the plurality of quick-disconnect connectors, and one of a plurality of releasably attachable objects.

FIG. 11 illustrates an enlarged, side elevation view of a portion of support 20, one of the plurality of quick-disconnect connectors 40, and one of the pluralities of objects 80. For example, lower member 24 may include a plurality of holes (only one shown in FIG. 11) through which quick-disconnect connector 40 may be attached using a threaded nut 42. Object 80 may include a string of relatively small round crystals 82, and a lower relatively large crystal 84. The crystals may have a bore therein and be connected using a plurality of wire links 86. The plurality of objects may also include strings of relatively small round crystals 82, and a plurality of spaced-apart relatively larger round crystals.

Figure 12:
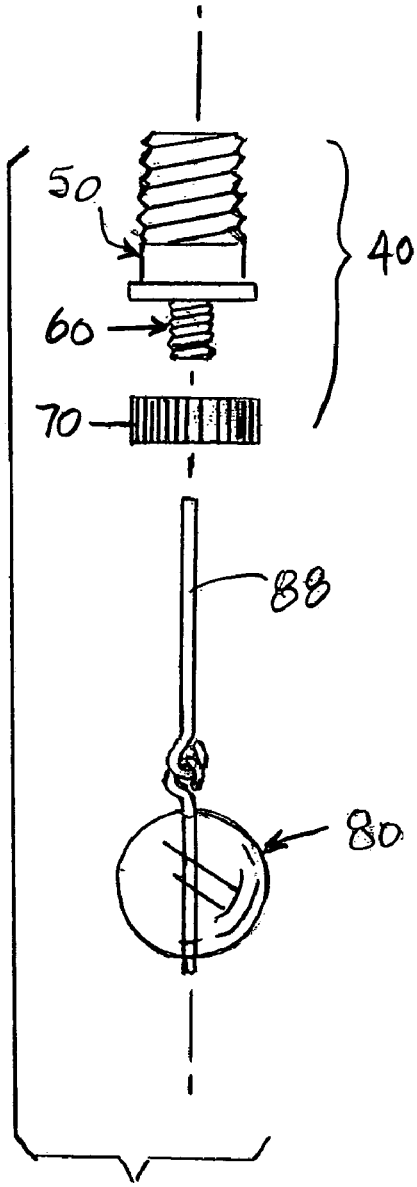
FIG. 12 is an enlarged, exploded, side elevational view of the quick-disconnect connector and the upper portion of the releasably attachable object of FIG. 11.

As best shown in FIG. 12, quick-disconnect connector 40 may include a housing 50, a slidable catch 60, and a knurled locking nut 70. The upper portion of object 80 may include an elongated generally straight pin 88 which is received in slidable catch 60 to suspend object 80 from support 20 as explained in greater detail below.

Figure 13:
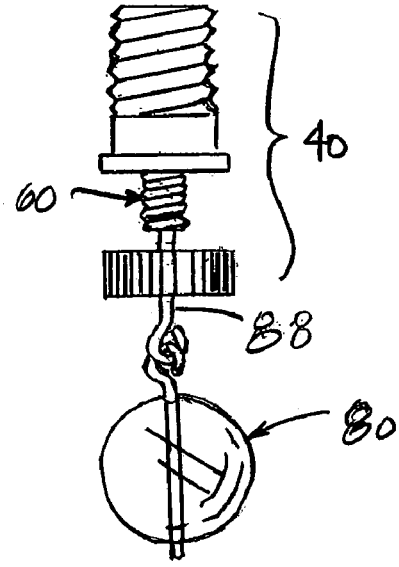
FIG. 13 is a side elevational view of the releasably attachable object initially connected to the quick-disconnect connector of FIG. 12.
Figure 14:
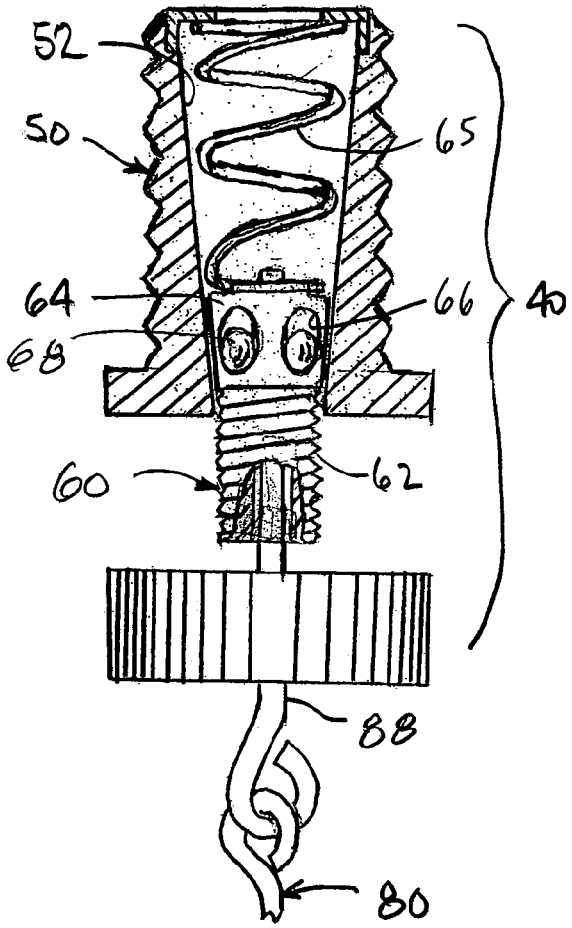
FIG. 14 is an enlarged, side elevational view, in part cross-section, of the releasably attachable object initially connected to the quick-disconnect connector of FIG. 13.

When initially attaching object 80 to quick-disconnect connector 40, as shown in FIGS. 13 and 14, pin 88 is inserted in a vertically-extending passageway (only a portion of which is shown in FIG. 14) in slidable catch 60 which self-locks pin 88 to quick-disconnect connector 60. As best shown in FIG. 14, housing 50 includes a tapered conical passageway 52 therein. Slidable catch 60 may include a lower threaded portion 62 and an upper tapered or conical portion 64. Upper portion 64 may include a plurality of holes 66, such as three equally spaced holes around upper conical portion 64. A plurality of ball bearings 68, such as three ball bearings, may be disposed in holes 66. The self-locking action of the connector is accomplished by a spring 65 which forces slidable catch 60 downwardly.

Figure 15:
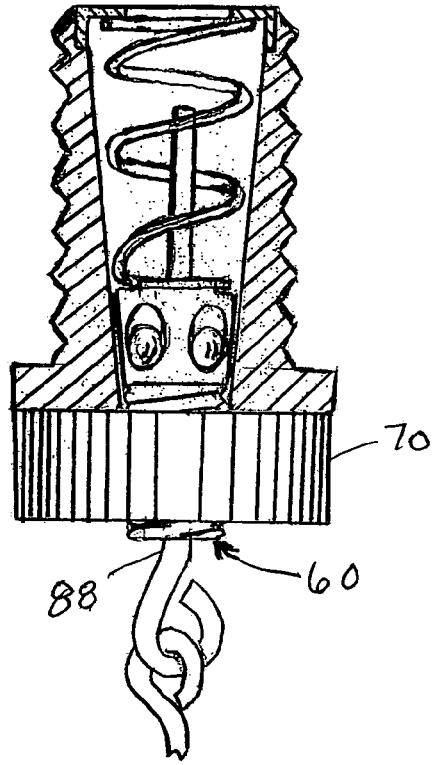
FIG. 15 is a side elevational view, in part cross-section, of the releasably attachable object connected to the quick-disconnect connector of FIG. 13 with the knurled nut secured in place.

When pin 88 is inserted into catch 60, the pin forces the ball bearing and the slidable catch upwardly to compress the spring. The slidable catch, which moves upwardly relative to the housing, provides a gap between the outer surface of the conical portion and the inner surface of the housing. This allows the pin to slide past the ball bearings. After removing the upward force on the pin, the spring forces the conical portion downwardly to its normal biased position to lock the pin in place by the action of the ball bearings being trapped and wedged between the outer surface of the pin and the inner tapered surface of the housing. The weight of the object also adds to the wedging effect of the ball bearings to hold the object in place. This results in reducing the likelihood of the objects disconnecting and falling from the support. Knurled nut 70 can then be threaded onto slidable catch 60 to securely lock pin 88 in place as shown in FIG. 15.

Figure 16:
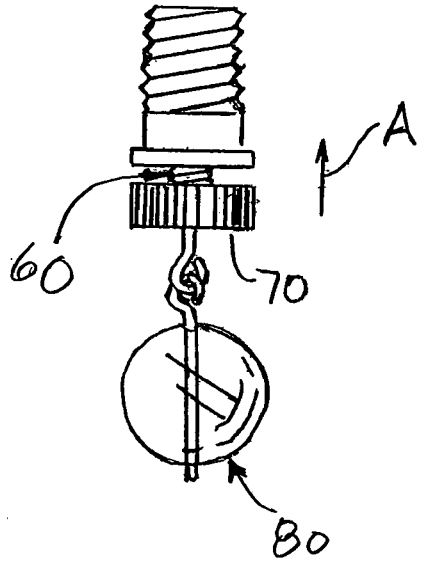
FIG. 16 is a side elevation view of the releasably attachable object and the quick-disconnect connector of FIG. 13 illustrating removal of the releasably attachable object from the quick-disconnect connector.
Figure 17:
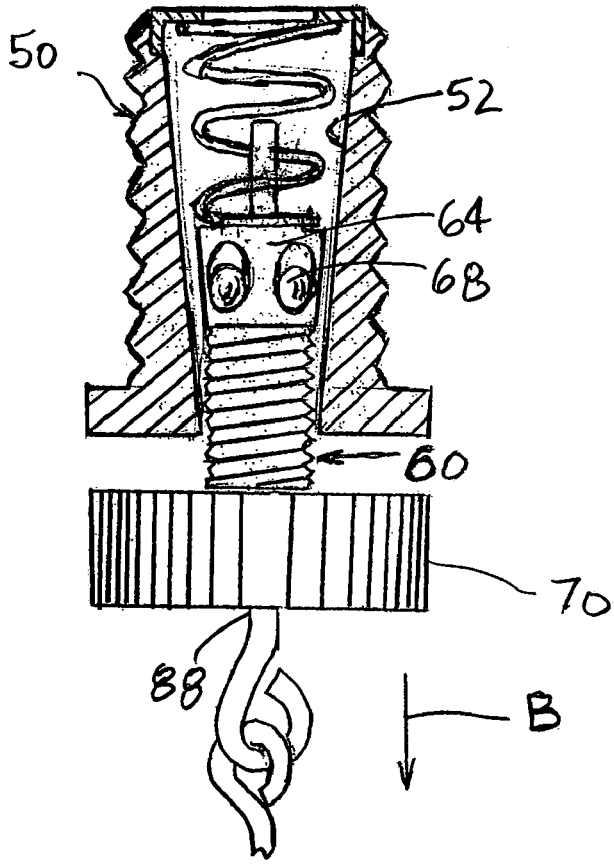
FIG. 17 is an enlarged, side elevation view, in part cross-section, of the releasably attachable object and the quick-disconnect connector of FIG. 16.

To detach object 80 from the support, as shown in FIG. 16, knurled nut 70 is sufficiently unthreaded from slidable catch 60. Thereafter, knurled nut 70 is pushed upwardly in the direction of arrow A so that lower portion of slidable catch may be pushed upwardly to a release position. As best shown in FIG. 17, pushing slidable catch 60 moves conical portion 64 upwardly and away from the inner conical surface 52 of housing 50. This removes the wedging effect of ball bearings 68 on pin 88 so that the pin may be removed, in the direction of arrow B, from the passageway in slidable catch 60, and thus allows detachment of the object from the quick-disconnect connector.

From the present description, the modular lighting fixtures of the present invention may be readily and securely trimmed with the plurality of releasably attachable objects reducing the costs to assemble and produce the modular lighting fixtures of the present invention compared to lighting fixtures where a wire is wrapped to connect each of the objects to the support. The plurality of releasably attachable objects may also be readily manufactured with simply configured upper ends having an elongated pin to reduce fabrication costs of the objects compared to the cost of fabricating modular lighting fixtures with objects having complicated hook configurations for attaching the objects to the support. The various modular lighting fixtures of the present invention also allow a customer to assemble the lighting fixtures or attach the objects at home, as well as allow the customer to readily disconnect the objects for cleaning or replacement with a new or different objects.

It will be appreciated by those skilled in the art that the modular lighting fixtures in accordance with the present invention may include a support fabricated from a metal such as aluminum or any suitable material. The support may be unadorned, adorned (e.g., with a mesh material), or may include any other decoration.

The quick-disconnect connectors may be suitable cable grips. Suitable cable grips such a GRIPLOCK gliders are available from GRIPLOCK Systems of Carpinteria, Calif., model Y4IP-KFts(25). Suitable cable grips are also available from Arakawa Hanging Systems of Portland, Oreg. Conventionally, cable grips are used to suspend a lighting fixture from a ceiling and allow level adjustment of the lighting fixture.

In addition, other suitable quick-disconnect connectors such as quick-disconnect connectors typically used on key chains may also be suitably employed in the modular lighting fixtures in accordance with the present invention. Still other suitable quick-disconnect connectors may include quick-disconnect connectors having one or more ball bearings or spring biased detents, resilient materials having teeth or catches, or other configurations having a normal self-locking first position and a second releasable position. It will also be appreciated that either the support or the objects may include the quick-disconnect connector. If two portions form the quick-disconnect connector, the support or the object may have either of the two halves which form the quick-disconnect connector.

The objects or ornaments supported from the quick-disconnect connectors may be round, faceted, or have any other shape, or combinations thereof. The objects or ornaments may also be fabricated from glass, crystal, plastic, metal, stone, or any other suitable material, and combinations thereof. The objects or ornaments may also be clear or translucent, opaque, solid, colored, or combinations thereof. The objects or ornaments may further be connected by a series of solid wires and linked together. The objects or ornaments may also be suitably strung on a solid wire or braided wire or cable, the upper end of which is received in or connectable to the quick-disconnect connectors. In addition, modular lighting fixtures in accordance with the present invention may include some of the objects or ornaments attached to the support by quick-disconnect connectors, and some of the objects or ornaments being permanently attached to the support (e.g., by wrapping a wire to attach the objects or ornaments to the support structure). The shape of the length of the various suspended objects may be varied to provide any configuration. The objects may also be replaced with one or more different objects to provide modular lighting fixtures with different looks. The quick-disconnect connectors may also be attached to the support in orientations other than that shown in the figures. For example, the passageway in the quick-disconnect may be disposed horizontally or at an angle.

From the present description, it will be appreciated by those skilled in the art that the present invention provides modular lighting fixtures and ornaments which may be readily and inexpensively assembled. For example, the support may be fabricated, the quick-disconnect connectors attached to the support, and the object connected to the quick-disconnect connectors. The objects may be connected by a manufacturer or by the purchaser or consumer.

Thus, while various embodiments of the present invention have been illustrated and described, it will be appreciated by those skilled in the art that many further changes and modifications may be made thereunto without departing from the spirit and scope of the invention.

The invention claimed is:

1. A modular lighting fixture comprising:

an elongated upper member having a first width and a first length;

an elongated lower member having a second width and a second length and being spaced-apart from said upper member, said lower member comprising a plurality of spaced-apart openings for light bulbs;

a plurality of objects attachable to and suspendable from said lower member; and wherein said first length equals said second length and said first width is greater than said second width.

2. The modular lighting fixture of claim 1 further comprising an end cap disposable at an end of said upper member and said lower member.

3. The modular lighting fixture of claim 1 wherein said modular lighting fixture is rectangular-shaped.

4. The modular lighting fixture of claim 1 wherein said modular lighting fixture is rectangular-shaped having a length of about 1 foot to about 2 foot, and a width of about 6 inches.

5. The modular lighting fixture of claim 1 wherein said modular lighting fixture is L-shaped.

6. The modular lighting fixture of claim 1 wherein said plurality of objects comprises a plurality of vertically suspended round-shaped crystal ornaments.

7. The modular lighting fixture of claim 1 wherein said plurality of objects comprises a plurality of vertically suspended spaced-apart large round-shaped crystals with a plurality of small round-shaped crystals spaced-apart therebetween.

8. The modular lighting fixture of claim 1 further comprising a sidewall disposed between said upper member and said lower member.

9. The modular lighting fixture of claim 1 further comprising a plurality of cable grips connected to said lower member for hanging said plurality of objects from said lower member.

10. The modular lighting fixture of claim 9 wherein said plurality of cable grips comprises a first self-locking position for connecting said plurality of objects to said lower member and a second releasable position for disconnecting said plurality of objects from said lower member.

11. The modular lighting fixture of claim 9 wherein said plurality of objects comprises a plurality of elongated pins connectable to said cable grips.

12. A lighting fixture comprising:

a plurality of modular lighting fixtures of claim 1 disposed in an elongated curtain.

13. A lighting fixture comprising:

a plurality of modular lighting fixtures of claim 1 spaced-apart from one another.

14. A lighting fixture comprising:

a plurality of modular lighting fixtures of claim 1 disposed in a rectangular-shaped configuration.

15. A lighting fixture comprising:

a plurality of modular lighting fixtures of claim 1 disposed in an L-shaped configuration.

16. A lighting fixture comprising:

a plurality of modular lighting fixtures of claim 1 disposed in a zigzag-shaped configuration.

17. A method for forming a lighting fixture, the method comprising:

providing a plurality of modular lighting fixtures of claim 1; and supporting the plurality of modular lighting fixtures from a ceiling.

18. The method of claim 17 wherein the supporting comprises abutting ends of the plurality of modular lighting fixtures to form an elongated curtain.

19. The method of claim 17 wherein the supporting comprises spacing the plurality of modular lighting fixtures apart from one another.

20. The method of claim 17 wherein the supporting comprises supporting the plurality of modular lighting fixtures in a rectangular-shaped configuration.

21. The method of claim 17 wherein the supporting comprises supporting the plurality of modular lighting fixtures in an L-shaped configuration.

22. The method of claim 17 wherein the supporting comprises supporting the plurality of modular lighting fixtures in a zigzag-shaped configuration.

23. A modular lighting fixture comprising:

an elongated support;

a plurality of objects;

a plurality of cable grips connected to said support for hanging said plurality of objects from said support; and wherein said plurality of objects comprises a plurality of elongated pins receivable in said cable grips, and wherein said plurality of cable grips comprises a first self-locking position for connecting said plurality of objects to said support and a second releasable position for disconnecting said plurality of objects from said support.

24. The modular lighting fixture of claim 23 wherein said support comprises an elongated upper member having a first width and a first length, an elongated lower member spaced-apart from said upper member and having a second width and a second length, and wherein said first length equals said second length and said first width is greater than said second width.

25. The modular lighting fixture of claim 23 further comprising an end cap disposable at an end of said support.

26. The modular lighting fixture of claim 23 wherein said support comprises a plurality of spaced-apart openings for light bulbs.

27. The modular lighting fixture of claim 23 wherein said modular lighting fixture is rectangular-shaped.

28. The modular lighting fixture of claim 23 wherein said modular lighting fixture is rectangular-shaped having a length of about 1 foot to about 2 foot, and a width of about 6 inches.

29. The modular lighting fixture of claim 23 wherein said modular lighting fixture is L-shaped.

30. The modular lighting fixture of claim 23 wherein said plurality of objects comprises a plurality of vertically suspended round-shaped crystal ornaments.

31. The modular lighting fixture of claim 23 wherein said plurality of objects comprises a plurality of spaced-apart large round-shaped crystals with a plurality of small round-shaped crystals spaced-apart therebetween.

32. A lighting fixture comprising:

a plurality of modular lighting fixtures of claim 23 disposed in an elongated curtain.

33. A lighting fixture comprising:

a plurality of modular lighting fixtures of claim 23 spaced-apart from one another.

34. A lighting fixture comprising:

a plurality of modular lighting fixtures of claim 23 disposed in a rectangular-shaped configuration.

35. A lighting fixture comprising:

a plurality of modular lighting fixtures of claim 23 disposed in an L-shaped configuration.

36. A lighting fixture comprising:

a plurality of modular lighting fixtures of claim 23 disposed in a zigzag-shaped configuration.

37. A method for forming a lighting fixture, the method comprising:

providing a plurality of modular lighting fixtures of claim 23; and supporting the plurality of modular lighting fixtures from a ceiling.

38. The method of claim 37 wherein the supporting comprises supporting the plurality of modular lighting fixtures in an elongated curtain.

39. The method of claim 37 wherein the supporting comprises supporting the plurality of modular lighting fixtures spaced-apart from one another.

40. The method of claim 37 wherein the supporting comprises supporting the plurality of modular lighting fixtures in a rectangular-shaped configuration.

41. The method of claim 37 wherein the supporting comprises supporting the plurality of modular lighting fixtures in an L-shaped configuration.

42. The method of claim 37 wherein the supporting comprises supporting the plurality of modular lighting fixtures in a zigzag-shaped configuration.

43. A modular lighting fixture comprising:

an elongated upper member having a first width and a first length;

an elongated lower member having a plurality of spaced-apart openings for light bulbs and spaced-apart from said upper member, said lower member having a second width and a second length, and said first length equals said second length and said first width is greater than said second width;

a sidewall disposed between said upper member and said lower member;

a plurality of objects attachable to and suspendable from said lower member, said plurality of objects comprises a plurality of vertically suspended round-shaped crystal ornaments of varying lengths and comprising a plurality of spaced-apart large round-shaped crystals with a plurality of small round-shaped crystals spaced-apart therebetween; and a plurality of cable grips connected to said lower member for hanging said plurality of objects from said lower member.

44. The modular lighting fixture of claim 43 further comprising an end cap disposable at an end of said upper member and said lower member.

45. The modular lighting fixture of claim 43 wherein said modular lighting fixture is rectangular-shaped.

46. The modular lighting fixture of claim 43 wherein said modular lighting fixture is rectangular-shaped having a length of about 1 foot to about 2 feet and a width of about 6 inches.

47. The modular lighting fixture of claim 43 wherein said modular lighting fixture is L-shaped.

48. The modular lighting fixture of claim 43 wherein said plurality of cable grips comprises a first self-locking position for connecting said plurality of objects to said lower member and a second releasable position for disconnecting said plurality of objects from said lower member.

49. A method for forming a lighting fixture, the method comprising:

providing a plurality of modular lighting fixtures of claim 43; and supporting the plurality of modular lighting fixtures from a ceiling.

50. The method of claim 49 wherein the supporting comprising supporting ends of the plurality of modular lighting fixtures to form an elongated curtain.

51. The method of claim 49 wherein the supporting comprising spacing the plurality of modular lighting fixtures spaced-apart from one another.

52. The method of claim 49 wherein the supporting comprising supporting the plurality of modular lighting fixtures in a rectangular-shaped configuration.

53. The method of claim 49 wherein the supporting comprising supporting the plurality of modular lighting fixtures in an L-shaped configuration.

54. The method of claim 49 wherein the supporting comprising supporting the plurality of modular lighting fixtures in a zigzag-shaped configuration.

55. A modular lighting fixture comprising:

an elongated support;

a plurality of objects;

a plurality of cable grips connected to said support for hanging said plurality of objects from said support; and wherein said elongated support comprises at least one of a) a rectangular-shape having a length of about 1 foot to about 2 foot, and a width of about 6 inches, and b) an L-shape.

56. The modular lighting fixture of claim 55 wherein said elongated support comprises said rectangular-shape having said length of about 1 foot to about 2 foot, and said width of about 6 inches.

57. The modular lighting fixture of claim 55 wherein said elongated support comprises said L-shape.

58. A lighting fixture comprising:

a plurality of modular lighting fixtures comprising:

an elongated support;

a plurality of objects; and a plurality of cable grips connected to said support for hanging said plurality of objects from said support; and wherein said plurality of modular lighting fixtures are disposed so that said plurality of elongated supports define at least one of a) a rectangular-shaped configuration, b) an L-shaped configuration; and c) a zigzag-shaped configuration.

59. The lighting fixture of claim 58 wherein said plurality of modular lighting fixtures is disposed so that said plurality of elongated supports define said rectangular-shaped configuration.

60. The lighting fixture of claim 58 wherein said plurality of modular lighting fixtures is disposed so that said plurality of elongated supports define said L-shaped configuration.

61. The lighting fixture of claim 58 wherein said plurality of modular lighting fixtures is disposed so that said plurality of elongated supports define said zigzag-shaped configuration.

62. A method for forming a lighting fixture, the method comprising:

providing a plurality of modular lighting fixtures comprising:

an elongated support;

a plurality of objects;

a plurality of cable grips connected to said support for hanging said plurality of objects from said support; and supporting the plurality of modular lighting fixtures from a ceiling so that the plurality of elongated supports define at least one of a) a rectangular-shaped configuration, b) an L-shaped configuration, and c) a zigzag-shaped configuration.

63. The method of claim 62 wherein the supporting comprises supporting the plurality of modular lighting fixtures so that the plurality of elongated supports define the rectangular-shaped configuration.

64. The method of claim 62 wherein the supporting comprises supporting the plurality of modular lighting fixtures so that the plurality of elongated supports define the L-shaped configuration.

65. The method of claim 62 wherein the supporting comprises supporting the plurality of modular lighting fixtures so that the plurality of elongated supports define the zigzag-shaped configuration.

66. A lighting fixture comprising:

a plurality of modular lighting fixtures comprising an elongated upper member having a first width and a first length, an elongated lower member having a second width and a second length and being spaced-apart from said upper member, a plurality of objects attachable to and suspendable from said lower member, and said first length equals said second length and said first width is greater than said second width; and wherein said plurality of modular lighting fixtures are disposed in an elongated curtain.

67. A lighting fixture comprising:

a plurality of modular lighting fixtures comprising an elongated upper member having a first width and a first length, an elongated lower member having a second width and a second length and being spaced-apart from said upper member, a plurality of objects attachable to and suspendable from said lower member, and said first length equals said second length and said first width is greater than said second width; and wherein said plurality of modular lighting fixtures are disposed so as to be spaced-apart from one another.

* * * * *